United States Patent [19]

Weirich et al.

[11] 4,427,321

[45] * Jan. 24, 1984

[54] MINERAL MINING INSTALLATION

[75] Inventors: Walter Weirich, Dortmund; Harry Rosenberg, Ludinghausen; Kunibert Becker, Werl, all of Fed. Rep. of Germany

[73] Assignee: Gewerkschaft Eisenhutte Westfalia, Lunen, Fed. Rep. of Germany

[ * ] Notice: The portion of the term of this patent subsequent to Dec. 29, 1998 has been disclaimed.

[21] Appl. No.: 305,977

[22] Filed: Sep. 28, 1981

Related U.S. Application Data

[62] Division of Ser. No. 145,982, May 2, 1980.

[30] Foreign Application Priority Data

May 2, 1979 [DE] Fed. Rep. of Germany ..... 2917609

[51] Int. Cl.[3] ..... E21D 15/14; E21D 23/18; E21D 23/26

[52] U.S. Cl. ..... 405/294; 405/299; 405/302

[58] Field of Search ..... 405/293, 294, 296, 298–302; 299/33

[56] References Cited

U.S. PATENT DOCUMENTS 3,436,922 4/1969 Irresberger et al. ..... 405/299 X
4,192,632 3/1980 Von Viebahn et al. ..... 405/298
4,217,067 8/1980 Lagodka et al. ..... 405/299 X
4,307,981 12/1981 Weirich et al. ..... 405/294

*Primary Examiner*—David H. Corbin
*Assistant Examiner*—Nancy J. Pistel
*Attorney, Agent, or Firm*—Thompson, Birch, Gauthier & Samuels

[57] ABSTRACT

A longwall mineral mining installation has a conveyor and a plurality of roof support units positioned side-by-side on the goaf side of the conveyor. Each roof support unit has a roof shield having an advanceable shield extension. Each unit has a first hydraulic ram for extending its shield extension, and a second hydraulic ram for advancing the conveyor. The extension of each first ram is controlled in dependence upon the retraction of one of the second rams (either the second ram of the same unit or that of an adjacent unit). This control is effected by controlling the supply of pressurized hydraulic fluid to the first rams. In one embodiment this is carried out by a control valve which has a spring-loaded plunger which engages with a series of equispaced cams on the movable cylinder of the associated second ram. In another embodiment, the piston rods of the rams are provided with series of equispaced magnets. The cylinders of the rams are provided with sensors, which sense the magnets and generate control signals. A control box is provided to direct the control signals to control valves associated with the rams, so that the first rams are extended by the same distance as that through which the second rams are retracted.

25 Claims, 4 Drawing Figures

MINERAL MINING INSTALLATION

This is a division of application Ser. No. 06/145,982 filed May 2, 1980.

BACKGROUND OF THE INVENTION

This invention relates to a longwall mineral mining installation having a conveyor and a plurality of roof support units positioned side-by-side along the goaf side of the conveyor, and in particular to control means for controlling the advance of shield extensions of the roof shields of the roof support units.

The shield extensions of such an installation are advanced towards the face being won by hydraulic rams associated with the corresponding roof shields. The shield extensions support the roof in the mineral mining working in the critical region adjacent to the face. It is important, therefore, to advance the shield extensions as soon as possible after the conveyor has been advanced following a cutting run of the plough (or other winning machine) along the face side of the conveyor. Known systems for advancing the shield extensions incorporate either manual control means or automatic control means.

In one known automatic control system, special sensors are provided on the shield extensions, these sensors serving to sense the position of the face, and to control the advance of the shield extensions in dependence upon their distance from the face. Such a system is relatively expensive. Moreover, this type of system is not very reliable, since the face does not constitute a well-defined limiting surface.

The aim of the invention is to provide control means for a mineral mining installation which does not suffer from these disadvantages.

SUMMARY OF THE INVENTION

The present invention provides a longwall mineral mining installation comprising a conveyor and a plurality of roof support units positioned side-by-side along the goaf side of the conveyor, each roof support unit having first and second double-acting hydraulic rams, wherein each first hydraulic ram is provided with control means responsive to the movement of one of the second hydraulic rams, and wherein each control means is such that the associated first ram moves through the same distance as said one second hydraulic ram.

Preferably, each first hydraulic ram is an advance ram for a shield extension of the roof shield of the associated roof support unit, and each second hydraulic ram is an advance ram for advancing a conveyor section associated with that roof support unit, and for advancing that roof support unit in a follow-up sequence.

Advantageously, each first hydraulic ram is controlled in dependence upon the movement of the second hydraulic ram of the same roof support unit. Alternatively, each first hydraulic ram is controlled in dependence upon the movement of the second hydraulic ram of an adjacent roof support unit. Preferably, each first hydraulic ram is advanced by the same distance as that through which said one second hydraulic ram is retracted.

Each control means may be constituted by a plurality of control elements attached to a movable part of the associated second hydraulic ram, and a stationary sensor for sensing the control elements and controlling the supply of pressurised hydraulic fluid to the associated first hydraulic ram, the control means being such that pressurised hydraulic fluid is supplied to the first hydraulic ram each time the sensor is actuated by one of the control elements. Advantageously, the control elements are equispaced.

In one preferred embodiment, a series of cams attached to the cylinder of the associated second hydraulic ram constitute the control elements, and the sensor is constituted by a hydraulic control valve provided with a spring-loaded plunger which is engagable with the cams. Alternatively, a series of permanent magnets may constitute the control elements, and the sensor may incorporate an induction coil for sensing the magnets. In either case, the sensor of each control means controls the supply of pressurised hydraulic fluid to the associated first hydraulic ram via a metering ram which passes a predetermined volume of pressurised hydraulic fluid to said first hydraulic ram, whereby said first hydraulic ram is moved through a predetermined distance. Advantageously, each metering ram is permanently supplied with hydraulic fluid at a first pressure in a direction tending to retract that ram, and with hydraulic fluid at a second, higher pressure via the associated control valve in a direction tending to extend that ram, whereby extension of the metering rams is controlled by their respective control valves.

In another preferred embodiment, each control means is constituted by a first control arrangement associated with the first hydraulic ram, a second control arrangement associated with the second hydraulic ram, and a control box, the first control arrangement controlling the movement of the first hydraulic ram in dependence upon signals received, via the control box, from the second control arrangement. Preferably, each control arrangement comprises a series of equispaced permanent magnets attached to the piston rod of the respective hydraulic ram, a control valve for controlling the supply of pressurised hydraulic fluid to that ram, and a sensor for sensing the magnets and generating signals, each control means being such that retraction of the piston rod of its second hydraulic ram is terminated by a first signal generated by the associated sensor, said first signal passing through the control box to the control valve associated with the second hydraulic ram thereby changing over this control valve to cut off the supply of pressurised hydraulic fluid to the second hydraulic ram, said first signal generating a second signal in the control box, said second signal passing to the control valve associated with the first hydraulic ram thereby changing over this control valve to supply pressurised hydraulic fluid to the first hydraulic ram thus initiating extension of the piston rod of the first hydraulic ram, extension of the piston rod of the first hydraulic ram being terminated by a third signal passing through the control box to the control valve associated with the first hydraulic ram thereby changing over this control valve to cut off the supply of pressurised hydraulic fluid to the first hydraulic ram, said third signal generating a fourth signal in the control box, said fourth signal passing to the control valve associated with the second hydraulic ram thereby changing over this control valve into the position in which pressurised hydraulic fluid can be passed to the second hydraulic ram.

Advantageously, each sensor incorporates an induction coil, the sensors generating said first and third signals whenever a magnet is in alignment with their induction coils.

Conveniently, the magnets are inlaid into their piston rods so that they lie flush with the outer cylindrical surfaces of the piston rods. Preferably, each magnet is enclosed within a brass capsule secured within a bore in the respective piston rod. The sensors may be fixed to the cylinders of their associated first and second hydraulic rams, and each control box may be an electric transformer and measured-value converter.

In either embodiment, each first hydraulic ram may be provided with a first manually-operable control valve, and each second hydraulic ram may be provided with a second manually-operable control valve, the manually-operable control valves controlling the flow of pressurised hydraulic fluid to their rams from hydraulic pressure and return lines. Also, there may be first and second hydraulic pressure lines, the first hydraulic pressure line containing a hydraulic fluid at a higher pressure than that in the second hydraulic pressure line, and wherein the arrangement is such that the first hydraulic rams are connectible to the first hydraulic pressure line, and the second hydraulic rams are connectible to the second hydraulic pressure line. In the case of the second embodiment, the control means may be such that retraction of the piston rod of a given second hydraulic ram is initiated by actuation of the associated second manually-operable control valve.

BRIEF DESCRIPTION OF THE DRAWINGS

Mineral mining installations constructed in accordance with the invention will now be described, by way of example, with reference to the accompanying drawings, in which.

DESCRIPTION OF PREFERRED EMBODIMENTS

Figure 1:
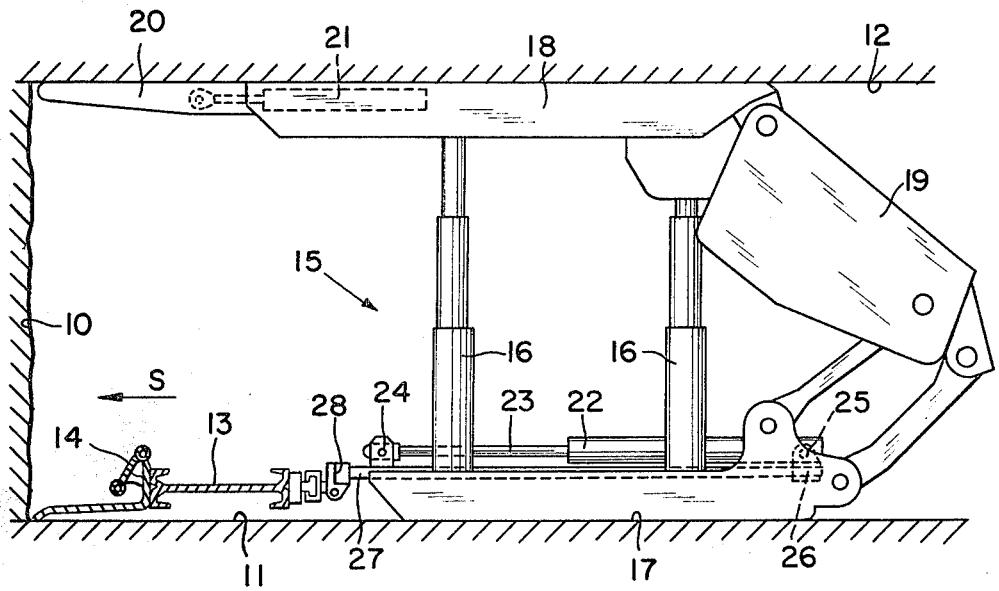
FIG. 1 is a side elevation of a mineral mining installation, and shows a longwall conveyor and a mine roof support unit positioned at the goaf side of the conveyor.
Figure 2:
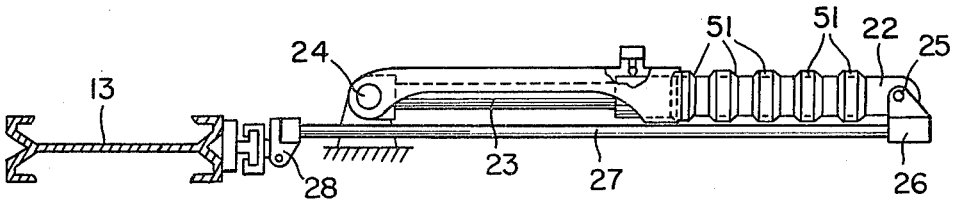
FIG. 2 is a side elevation, on a larger scale of part of the installation shown in FIG. 1.

Referring to the drawings, FIG. 1 shows a long-wall mineral mining working having a face 10, a floor 11 and a roof 12. A scraper-chain conveyor 13 extends along the working adjacent to the face 10. A plough guide 14 is provided at the face side of the conveyor, a plough (not shown) being drivable to and fro along the guide for winning mineral material (such as coal) from the face 10.

A mine roof support assembly is positioned at the goaf side of the conveyor 13, the assembly being constituted by a plurality of mine roof support units 15 positioned side-by-side. Each roof support unit 15 has four hydraulic props 16 mounted on a floor sill 17, the props carrying a roof shield 18 for supporting the roof 12. The props 16 are arranged at the corners of a rectangle, and each of the props is joined to the roof shield 18 by means of a ball joint (not shown). The floor sill 17 may be made in one piece, or it may be of multi-part construction. A goaf shield 19 is pivotally attached to the rear (goaf) ends of the roof shield 18 and the floor sill 17. The roof shield 18 is provided with a forward extension 20, which slidingly engages the roof shield, and which can be advanced towards the face 10 by means of a hydraulic ram 21.

As the face 10 is won, the conveyor 13 is advanced to follow up the advance of the face. The conveyor 13 is advanced by means of advance rams 22 associated with the roof support units 15. Each advance ram 22 has a piston rod 23 which is pivotally attached, at 24, to a bracket fixed to the face-side end of the floor sill 17 of the associated roof support unit 15. The cylinder of that advance ram 22 is pivotally connected, at 25, to a cross-piece 26 attached to the rear (goaf) end of a guide linkage, constituted by a pair of parallel, resilient, steel rods 27. The front (face) ends of the rods 27 are connected by a head 28 which is attached to the conveyor 13. The arrangement is such that retraction of the advance rams 22 causes the conveyor 13 to be advanced, in the direction of the arrow S, by the guide rods 27, the roof support units 15 forming an abutment for this advance of the conveyor. Similarly, by extending the advance rams 22, the roof support units 15 are advanced in a follow-up sequence, the conveyor 13 acting as an abutment for this advance movement. As is usual the conveyor 13 is advanced several times before it is necessary for the roof support units to be advanced. This is because the cutting depth of the plough is considerably smaller than the length of the working stroke of the advance rams 22.

The roof 12 of the working must be effectively supported at all times, particularly in the region of the face 10. For this purpose, the shield extensions 20 are arranged to be advanced automatically towards the face 10 as the conveyor 13 is advanced by the advance rams 22. Usually, the conveyor 13 is advanced in sections, each conveyor section being advanced after the plough has left that section on its winning run.

Figure 3:
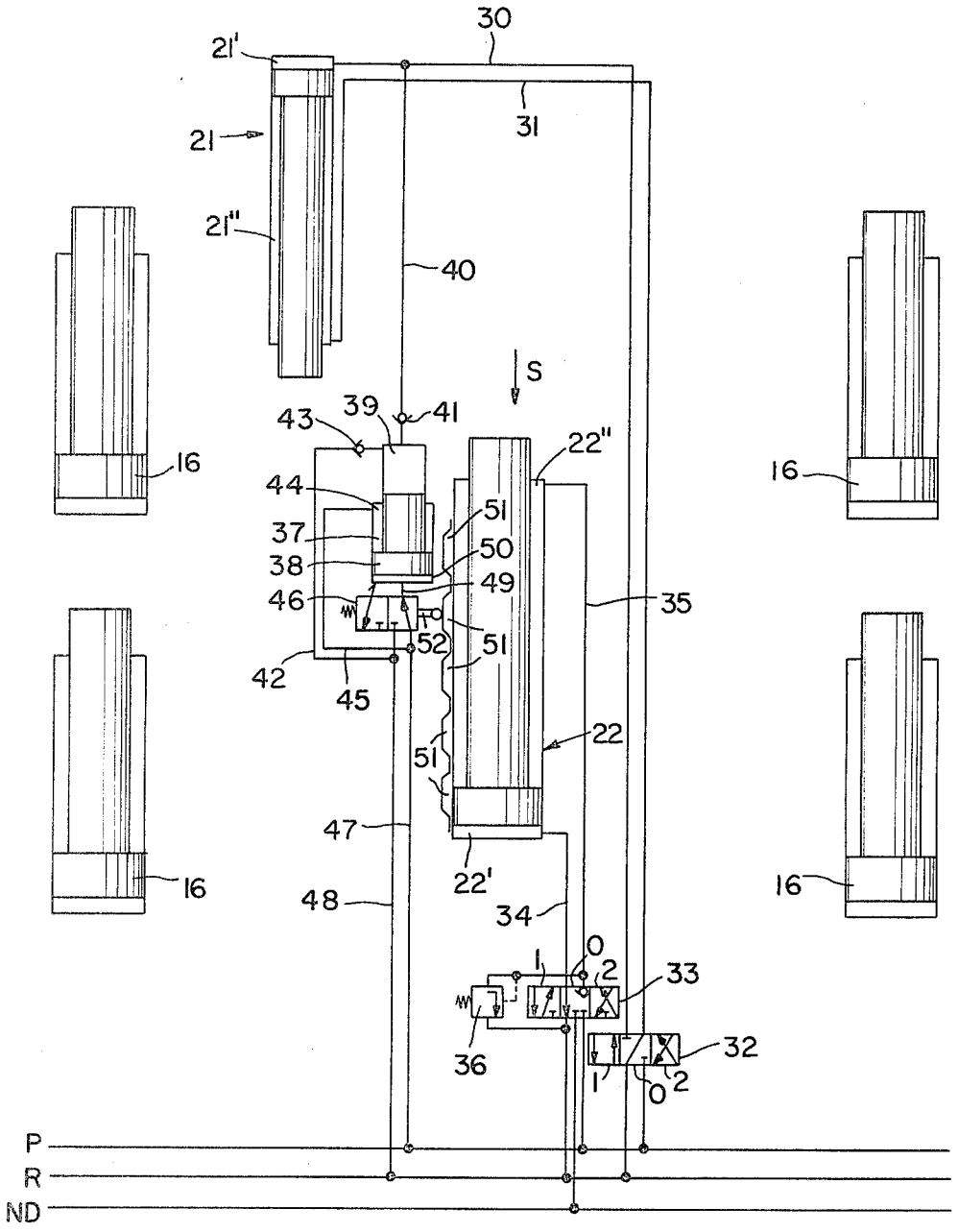
FIG. 3 is a hydraulic circuit diagram of the installation shown in FIGS. 1 and 2.

FIG. 3 shows a hydraulic circuit for controlling the double-acting hydraulic ram 21 associated with the shield extension 20 of one roof support unit 15. Each of the roof support units 15 has a similar hydraulic control circuit. The ram 21 has two chambers 21' and 21'', pressurisation of the chamber 21' serving to extend the ram, and pressurisation of the chamber 21'' serving to retract the ram. The chambers 21' and 21'' are connected, via hydraulic lines 30 and 31 respectively, to the outlet ports of a manually-operated control valve 32. The inlet ports of the control valve are connected to hydraulic high-pressure and return lines P and R respectively, which extend along the longwall working and serve the control circuits of all the roof support units 15. The control valve 32 has three control positions 1, 0, 2. In the control position 0 (as illustrated in FIG. 3), the chamber 21'' of the ram 21 is connected to the return line R, and the chamber 21' is cut off from both lines P and R. Consequently, the ram 21 is hydraulically locked against extension or retraction. In the control position 1, the chamber 21'' is connected to the high-pressure line P, and the chamber 21' is connected to the return line R, so that the ram 21 is retracted. Similarly, in the control position 2, the chamber 21' is connected to the high-pressure line P, and the and the chamber 21'' is connected to the return line R, so that the ram 21 is extended.

The advance ram 22 also has two chambers, namely a chamber 22' pressurisation of which serves to extend the ram, and a chamber 22'' pressurisation of which serves to retract the ram. The chambers 22' and 22'' are connected, via hydraulic lines 34 and 35 respectively, to the outlet ports of a manually-operable control valve 33. The inlet ports of the control valve 33 are connected to the high-pressure and return lines P and R respectively. The inlet port connected to the high-pressure line P is associated with a parallel inlet port connected to a low-pressure line ND. A pressure-limiting valve 36 is connected in parallel with the control valve 33 between the hydraulic line 35 and the return line R. The control valve 33 is similar to the control valve 32 in that it has three control positions 1, 0, 2. As with the control valve 32, the advance ram 22 is hydraulically locked when the control valve 33 is in the control position 0. When the control valve 33 is in the control position 1, the chamber 22'' of the advance ram 22 is connected to the low-pressure line ND and the chamber 22' is connected to the return line R. Consequently, the advance ram 22 is retracted using the lower pressure of the low-pressure conduit ND, so that the associated section of the conveyor 13 is advanced in the direction of the arrow S (see FIG. 1). On the control position 2 of the control valve 33, the chamber 22' of the advance ram is connected to the high-pressure line P, and the chamber 22'' is connected to the return line R. Thus, the roof support unit 15 is advanced, to follow-up the successive advances of the associated conveyor section, using the higher pressure of the high-pressure line P. In practice, the pressure in the high-pressure line P is of the order of 350 to 450 bars, whereas the pressure in the low-pressure line ND is of the order of 150 to 250 bars.

A metering ram 37 is associated with the ram 21, the metering ram having a stepped piston 38 arranged within a stepped cylinder. The metering ram 37 has three chambers, namely a cylindrical metering chamber 39, a cylindrical chamber 59, and an annular chamber 44. The metering chamber 39 has a smaller diameter than the chamber 50. The metering chamber 39 is connected, via a hydraulic line 40, to the hydraulic line 30, the line 40 incorporating a non-return valve 41. The metering chamber 39 is also connected, via a hydraulic line 42 incorporating a non-return valve 43, to a line 48 which leads from one inlet port of a control valve 46 to the return line R. The annular chamber 44 is connected, via a hydraulic line 45, to a hydraulic line 47 which leads from the other inlet part of the control valve 46 to the high-pressure line P. The outlet port of the control valve 46 is connected, via a hydraulic line 49, to the chamber 50 of the metering ram 37.

The cylinder of the advance ram 22 carries a series of equispaced cams 51, the spacing between adjacent cams being equal to the distance by which the conveyor 13 is to be advanced after each passage of the plough. The control valve 46 is operated by a spring-biased plunger 52, which is actuated by the cams 51.

Assuming that the conveyor 13 and the roof support unit 15 are in the positions shown in FIG. 1, the control circuit works in the following manner. In FIG. 1, the advance ram 22 is fully extended and the ram 21 of the shield extension 20 is retracted. The plough, which is driven along the plough guide 14, has a cutting depth of 140 millimeters, so that the conveyor 13 needs to be advanced by 140 millimeters after each cutting run of the plough. Accordingly, the cams 51 are spaced apart by 140 millimeters. In order to advance a given conveyor section, the associated control valve 33 is brought into the control position 1. This connects the chamber 22'' of the associated advance ram 22 to the low-pressure line ND. The advance ram 22 is, therefore, retracted. During retraction, the piston rod 23 of the advance ram 22 remains stationary, and its cylinder moves in the direction of the arrow S (see FIG. 1). As the cylinder of the advance ram 22 moves, the spring-biased plunger 52 of the control valve 46 engages one of the cams 51 to bring the control valve 46 into the position shown in FIG. 3. In this position, the chamber 50 of the metering ram 37 is connected to the high-pressure line P. This causes the piston 38 of the metering ram 37 to move, ejecting a metered amount of hydraulic fluid from the metering chamber 39. This metered amount of fluid passes along the line 40, through the non-return valve 41, and into the chamber 21' of the ram 21. The ram 21 is, therefore, extended. The metered amount of hydraulic fluid is adapted to the volume of the chamber 21' so that the ram 21 is extended by the same distance as that through which the conveyor 13 is advanced, namely 140 millimeters. As the cylinder of the advance ram 22 continues to move, the plunger 52 engages within a recess between two adjacent cams 51, so that the control valve 46 switches to its other operating position under the action of its spring. In this position, the chamber 50 of the metering ram 37 is connected, via the lines 49 and 48, to the return line R. Since the annular chamber 44 of the metering ram 37 is permanently connected to the high-pressure line P (via the lines 45 and 47), the piston 38 is returned, whereby hydraulic fluid is drawn into the metering chamber 39 from the return line R via the lines 42 and 48. The metering ram 37 is then charged, ready for the next advance stroke which will be initiated by the plunger 52 engaging the next cam 51 on the cylinder of the advance ram 22.

It will be apparent, therefore, that each ram 21 advances the associated shield extension 20 in the direction of the arrow S each time the associated conveyor section is advanced by the corresponding advance ram 22 towards the face 10, the shield extensions 20 being advanced by the same distance as that through which the conveyor 13 is advanced. Thus, it is ensured that the shield extensions 20 adequately support the roof 12 in the region of the face 10 at all times.

When the advance rams 22 have been fully retracted (in a number of steps which corresponds to the number of rams 51), the associated roof support units 15 are advanced, in a follow-up movement. Each unit 15 is advanced by bringing its control valve 33 into the control position 2. In this position, the chamber 22' of the advance ram 22 is connected to the high-pressure line P. At the same time, the corresponding control valve 32 is brought into the control position 1, so that the ram 21 is retracted as the roof support unit 15 is advanced.

Since the rams 21 are extended using hydraulic fluid from the high-pressure line P, the shield extensions 20 can be advanced reliably, even when the roof support units are under load and a considerable resistance to shield extension advance must be overcome.

In a modified arrangement, the cams 51 are replaced by permanent magnets, and the control valve 46 is replaced by a sensor incorporating an induction coil. As with the embodiment using the cams 51, the magnets are fixed to the cylinders of the advance rams 22, the magnets of each advance ram being equispaced, the spacing being equal to the incremental advance steps of the conveyor 13, namely 140 millimeters. The sensors which replace the control valves 46 are used to control the operation of the metering rams 37. It would also be possible to utilise other forms of contactless control of the metering rams 37. For example, the magnets could be replaced by radioactive or optical sources, in which case the sensors would be sensitive to radiation or light. Such contactless control devices are actually preferred to the cam devices, as the latter are susceptible to interference from coal dust and dirt. This can lead to unreliable activation of the metering rams 37, and hence to unreliable operation of the rams 21 controlling the advance of the shield extensions 20.

Figure 4:
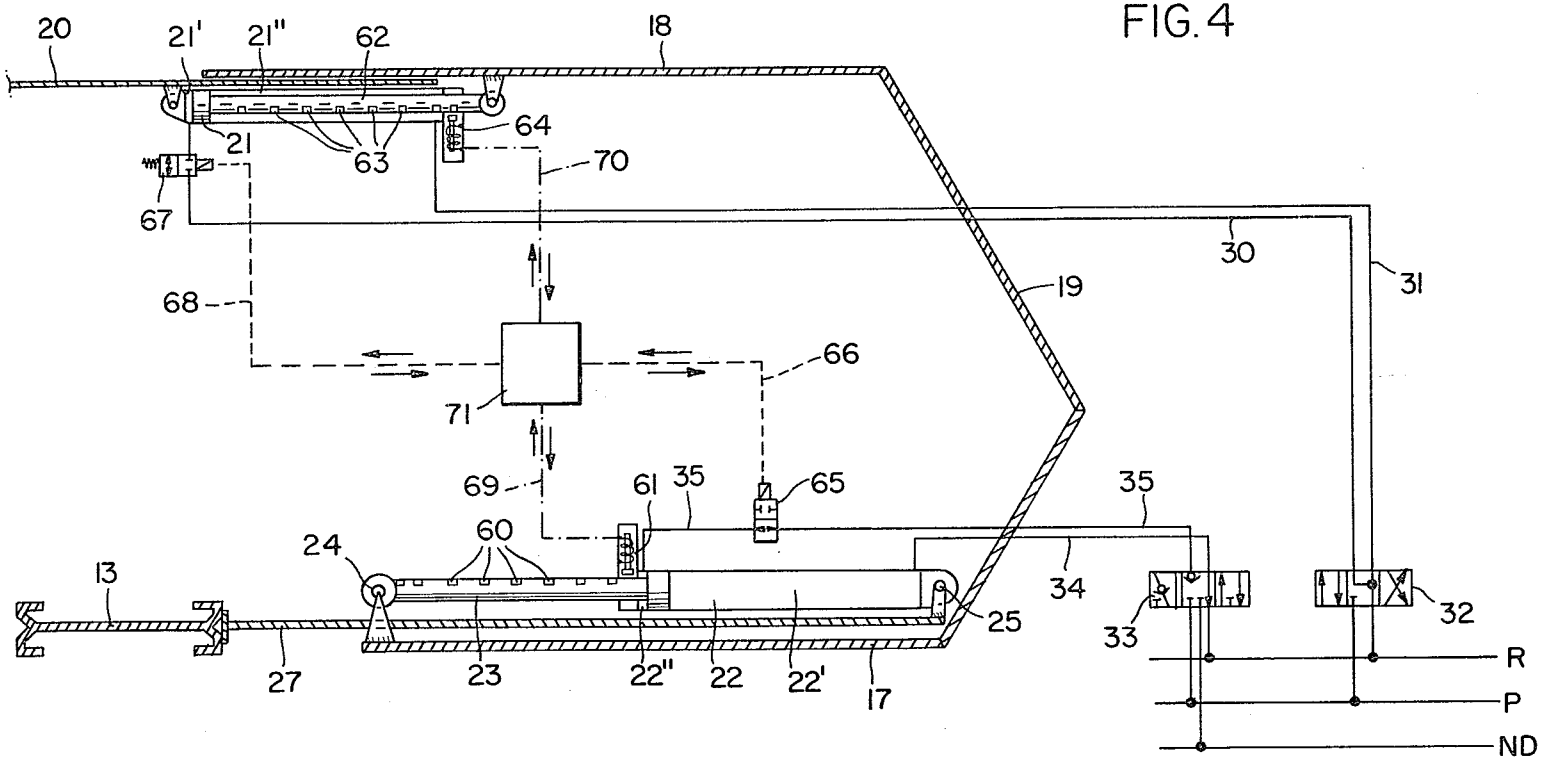
FIG. 4 is a modified hydraulic circuit diagram for use with the installation shown in FIGS. 1 and 2.

FIG. 4 shows a preferred form of contactless control arrangement, in which the rams 21 are controlled by the movement of the advance rams 22. Many of the parts shown in FIG. 4 are the same as parts of the FIG. 3 arrangement, and the same reference numbers are used for these parts. The main difference between the arrangements is that the metering rams 37 the control valves, 46 and the cams 51 of the FIG. 3 arrangement are replaced by contactless control devices. Moreover, the ram 21 of one roof support unit 15 is controlled by the movement of the piston rod of the advance ram 22 of the preceding roof support unit, though the schematic nature of FIG. 4 does not make this clear.

FIG. 4 shows the hydraulic control circuit associated with one ram 21 and its associated advance ram 22, the other pairs of associated rams 21 and 22 having similar control circuits. A series of equispaced permanent magnets 60 are provided on the piston rod 23 of the advance ram 22. The magnets 60 are spaced apart by a distance which equals the incremental advance step of the conveyor 13, namely 140 millimeters. Each of the magnets 60 is inlaid into the surface of the piston rod 23, so that the magnets lie flush with the piston rod. A sensor 61, which incorporates an induction coil, is provided on the cylinder of the advance ram 22 to sense the magnets 60 and to emit an appropriate control signal whenever a magnet is in alignment therewith. The control signal emitted by the sensor 61 is passed to a control box 71 via an electrical lead 69.

Similarly, the piston rod 62 of the ram 21 is provided with a series of equispaced permanent magnets 63, these magnets also being spaced by distances of 140 millimeters, and being inlaid into the piston rod. The cylinder of the ram 21 is provided with a sensor 64, which incorporates an induction coil, and emits a control signal whenever a magnet 63 is in alignment therewith. The control signal emitted by the sensor 64 is passed to the control box 71 via an electrical lead 70.

An electromagnetically-actuated 2/2 way valve 65 is provided in the hydraulic line 35 leading from the chamber 22'' of the advance ram 22 to its control valve 33. The valve 65 normally keeps the line 35 open, and blocks the line 35 only when an electrical control signal is received by way of a lead 66 from the control box 71. Similarly an electromagnetically-actuated 2/2 way valve 67 is provided in the hydraulic line 30 leading from the chamber 21' of the ram 21 to its control valve 32. The valve 67 is also such as to keep the line 30 open unless an electrical control signal is received from the control box 71 via a line 68.

FIG. 4 shows the arrangement in the position in which the ram 21 (and so the shield extension 20) is fully retracted, and the advance ram 22 is fully extended. Since the sensor 64 is in alignment with one of the magnets 63, the sensor 64 emits a control signal which passes along the lead 70 to the control box 71, which in turn passes a control signal along the lead 68 to move the valve 67 into the closed position. Consequently, hydraulic fluid is prevented from reaching the chamber 21' of the ram 21. However, since the sensor 61 is not in alignment with one of the magnets 60 of the piston rod 23 of the advance ram 22, the sensor 61 does not emit a control signal, and so the valve 65 remains open. Thus, when the control valves 32 and 33 are moved to their control positions 2 and 1 respectively (namely to "extend the shield extension 20" and to "advance the conveyor 13"), then the ram 22 is retracted until the first magnet 60 is in alignment with the sensor 61. This energises the sensor 61 which emits a control signal which passes along the lead 69, through the control box 71, and along the lead 66 to change the valve 65 to its closed position. This results in the chamber 22'' being disconnected from the high-pressure line P, so that the retraction of the advance ram 22 is halted. Simultaneously, a control signal is passed from the control box 71 along the lead 68 to open the valve 67. This connects the chamber 21' of the ram 21 to the high-pressure line P, so that the ram 21 is extended to drive the associated shield extension 20 out. However, as soon as the first magnet 63 is in alignment with the sensor 64, the sensor 64 emits a control signal which passes along the lead 70, through the control box 71, and along the lead 68 to the valve 67. This closes the valve 67, which disconnects the chamber 21' from the high-pressure line P, so that the extension of the ram 21 is halted. Simultaneously, the valve 65 is opened by a control signal passed along the lead 66 from the control box 71. The system is them ready for the next retraction of the advance ram 22 which moves the conveyor 13 forward a further incremental advance step.

With this arrangement, each shield extension 20 is advanced by the same distance (140 millimeters) as that through which the "preceding" advance ram 22 was retracted to advance the attached conveyor section. Moreover, because the magnets 63 are spaced apart in identical fashion to the magnets 60, the rams 21 are advanced by exactly the same distance as that through which the advance rams 22 are retracted. Consequently, the contactless control arrangement is more reliable than that utilising cams. Furthermore, the contactless control arrangement does not suffer from problems associated with the accumulation of coal dust or dirt.

The magnets 60 and 63 are set in bores formed in the piston rods 23 and 62 respectively. Preferably, each magnet 60, 63 is enclosed within a brass capsule, and the brass capsules are soldered into the bores in the piston rods 23 and 62. Once the magnets 60 and 63 have been secured in position in this manner, the entire surface of each of the piston rods 23 and 62 is provided with a metal coating such as a chromium or nickel coating.

Obviously, the control arrangement of FIG. 4 could be modified in a number of ways. In particular, the advance of the ram 21 of each roof support unit 15 could be controlled in dependence upon the retraction of the advance ram 22 of the same roof support unit, rather than that of the preceding unit. Also, the rams 21 of a group of roof support units 15 could have a common control arrangement actuated in dependence upon either the retraction of the advance rams 22 of the same group of roof support units, or the retraction of the advance rams 22 of the preceding group of roof support units. Similarly, the control arrangement of FIG. 3 could be modified so that the advance of each ram 21 is controlled by the retraction of the advance ram 22 of the preceding roof support unit 15. Again the FIG. 3 arrangement could be modified so that the rams 21 of a group of roof support units 15 are controlled by the retraction of the advance rams 22 of that group or the preceding group.

It would also be possible to utilise other forms of contactless control in the arrangement of FIG. 4. For example, the magnets 60 and 63 could be replaced by radioactive or optical sources, in which case the sensors 61 and 64 would be sensitive to radiation or light.

Obviously, it would be possible to control the movement (either extension or retraction) of any hydraulic ram of such a mineral mining installation in dependence upon the movement (either extension or retraction) of any other ram of that installation. Moreover, the distance through which the controlled ram is moved need not be the same as that through which the controlling ram moves. Controlled rams are, however, always moved through the same fixed distance which is in a fixed ratio to the distance through which the controlling ram moves. In the embodiment of FIG. 3 this variability of movement of the controlled rams can be effected by having metering rams whose metering chambers are adjustable, or by replacing one metering ram with another metering ram having a differently sized metering chamber. In the embodiment of FIG. 4, this variability is accomplished by spacing the magnets 63 differently from the magnets 60.

We claim:

1. A longwall mineral mining installation comprising a conveyor and a plurality of roof support units positioned side-by-side along the goaf side of the conveyor, the roof support units having a plurality of first and second double-acting hydraulic rams, each first hydraulic ram being associated with control means responsive to the movement of one of the second hydraulic rams, and each control means being such that the associated first hydraulic ram moves through a distance proportional to that through which the associated second hydraulic ram moves, wherein each control means is actuated by a respective sensing means which senses the movement of the associated second hydraulic ram.

2. An installation according to claim 1, wherein each control means is such that the associated first hydraulic ram moves through the same distance as the associated second hydraulic ram.

3. An installation according to claim 2, wherein each roof support unit has a roof shield provided with an advanceable shield extension, and wherein each first hydraulic ram is an advance ram for the shield extension of the roof shield of the associated roof support unit, and each second hydraulic ram is an advance ram for advancing a conveyor section associated with that roof support unit, and for advancing that roof support unit in a follow-up sequence.

4. An installation according to claim 3, wherein each first hydraulic ram is controlled in dependence upon the movement of the second hydraulic ram of the same roof support unit.

5. An installation according to claim 3, wherein each first hydraulic ram is controlled in dependence upon the movement of the second hydraulic ram of an adjacent roof support unit.

6. An installation according to claim 3, wherein each first hydraulic ram is advanced by the same distance as that through which said one second hydraulic ram is retracted.

7. An installation according to claim 1, wherein each control means includes a plurality of control elements provided on a movable part of the associated second hydraulic ram, and a stationary sensor for securing the control elements and controlling the supply of pressurized hydraulic fluid to the associated first hydraulic ram, each control means being such that pressurized hydraulic fluid is supplied to the associated first hydraulic ram each time the associated sensor is actuated by one of the associated control elements, the sensors constituting said sensing means.

8. An installation according to claim 7, wherein the control elements of each control means are equispaced.

9. An installation according to claim 8, wherein a series of cams attached to the cylinder of the associated second hydraulic ram constitute the control elements of each control means, and each sensor is constituted by a hydraulic control valve provided with a spring-loaded plunger which is engageable with the associated cams.

10. An installation according to claim 9, wherein the control valve of each control means controls the supply of pressurized hydraulic fluid to the associated first hydraulic ram via a metering ram which passes a predetermined volume of pressurized hydraulic fluid to said first hydraulic ram, whereby said first hydraulic ram is moved through a predetermined distance.

11. An installation according to claim 10, wherein each metering ram is permanently supplied with hydraulic fluid at a first pressure in a direction tending to retract that ram, and with hydraulic fluid at a second, higher pressure via the associated control valve in a direction tending to extend that ram, whereby extension of the metering rams is controlled by their respective control valves.

12. An installation as claimed in claim 1, wherein each control means includes a first control arrangement associated with the first hydraulic ram, a second control arrangement associated with the second hydraulic ram, and a control box, the first control arrangement controlling the movement of the first hydraulic ram in dependence upon signals received, via the control box, from the second control arrangement.

13. An installation according to claim 12, wherein each control arrangement comprises a series of equispaced permanent magnets provided on the piston rod of the respective hydraulic ram, a control valve for controlling the supply of pressurized hydraulic fluid to that ram, and a sensor for sensing the magnets and generating signals, the sensors of the second hydraulic rams constituting said sensing means, each control means being such that retraction of the piston rod of its second hydraulic ram is terminated by a first signal generated by the associated sensor, said first signal passing through the control box to the control valve associated with the second hydraulic ram thereby changing over this control valve to cut off the supply of pressurized hydraulic fluid to the second hydraulic ram, said first signal generating a second signal in the control box, said second signal passing to the control valve associated with the first hydraulic ram thereby changing over this control valve to supply pressurized hydraulic fluid to the first hydraulic ram thus initiating extension of the piston rod of the first hydraulic ram, extension of the piston rod of the first hydraulic ram being terminated by a third signal passing through the control box to the control valve associated with the first hydraulic ram thereby changing over this control valve to cut off the supply of pressurized hydraulic fluid to the first hydraulic ram, said first signal generating a fourth signal in the control box, said fourth signal passing to the control valve associated with the second hydraulic ram thereby changing over this control valve into the position in which pressurized hydraulic fluid can be passed to the second hydraulic ram.

14. An installation according to claim 13, wherein each sensor incorporates an induction coil, the sensors generating said first and third signals whenever a magnet is in alignment with their induction coils.

15. An installation according to claim 13, wherein the magnets are inlaid into their piston rods so that they lie flush with the outer cylindrical surfaces of the piston rods.

16. An installation according to claim 15, wherein each magnet is enclosed within a metal capsule secured within a bore in the respective piston rod.

17. An installation according to claim 16, wherein each said metal capsule is a brass capsule.

18. An installation according to claim 13, wherein the sensors are fixed to the cylinders of their associated first and second hydraulic rams.

19. An installation according to claim 13, wherein each control box is an electric transformer and measured-valve converter.

20. An installation according to claim 1, wherein each first hydraulic ram is provided with a first manually-operable control valve, and each second hydraulic ram is provided with a second manually-operable control valve, the manually-operable control valves controlling the flow of pressurized hydraulic fluid to their rams from hydraulic pressure and return lines.

21. An installation according to claim 13, wherein each first hydraulic ram is provided with a first manually-operable control valve, and each second hydraulic ram is provided with a second manually-operable control valve, the manually-operable control valves controlling the flow of pressurized hydraulic fluid to their rams from hydraulic pressure and return lines.

22. An installation according to claim 21, wherein the control means are such that retraction of the piston rod of a given second hydraulic ram is initiated by actuation of the associated second manually-operable control valve.

23. An installation according to claim 13, wherein there are first and second hydraulic pressure lines, the first hydraulic pressure line containing a hydraulic fluid at a higher pressure than that in the second hydraulic pressure line, and wherein the arrangement is such that the first hydraulic rams are connectible to the first hydraulic pressure line, and the second hydraulic rams are connectible to the second hydraulic pressure line.

24. In a longwall mineral mining installation comprising a conveyor and a plurality of roof support units positioned side-by-side along the goaf side of the conveyor, the roof support units having a plurality of first and second double-acting hydraulic rams, the improvement comprising providing each first hydraulic ram with control means responsive to the movement of one of the second hydraulic rams, each control means being such that the associated first hydraulic ram moves through a distance proportional to that through which said one second hydraulic ram moves, wherein each control means is actuated by a respective sensing means which senses the movement of the associated second hydraulic ram.

25. A hydraulic arrangement for a longwall mineral mining installation comprising a conveyor and a plurality of roof support units positioned side-by-side along the goaf side of the conveyor, the hydraulic arrangement having first and second double-acting hydraulic rams on said roof support units, and control means for controlling the movement of the first hydraulic ram, the control means being responsive to the movement of the second hydraulic ram, the control means being such that the first hydraulic ram moves through a distance proportional to that through which the second hydraulic ram moves, wherein the control means is actuated by a sensor which senses the movement of the second hydraulic ram.

* * * * *